United States Patent [19]

Bates

[11] 4,063,730

[45] Dec. 20, 1977

[54] TENNIS RACQUET SWING TRAINING DEVICE

[75] Inventor: Ronald E. Bates, New York, N.Y.

[73] Assignee: Tennis-Tee, Inc., New York, N.Y.

[21] Appl. No.: 699,925

[22] Filed: June 25, 1976

[51] Int. Cl.[2] ..... A63B 69/38

[52] U.S. Cl. ..... 273/29 A; 124/5

[58] Field of Search ..... 273/29 A, 73 R, 26, 273/96 R, 77 R, 77 A; 124/4, 5

[56] References Cited

U.S. PATENT DOCUMENTS

| | | | |
|---|---|---|---|
| 1,540,823 | 6/1925 | Mairhofen | 273/73 R |
| 2,465,124 | 3/1949 | Quattria | 124/5 |
| 2,738,976 | 3/1956 | Vallieres | 273/73 R |
| 2,932,514 | 4/1960 | Bergmark | 273/73 R |
| 2,966,280 | 12/1960 | Nelson | 273/73 R |
| 3,115,129 | 12/1963 | Merriman | 273/96 R |
| 3,496,924 | 2/1970 | Miller | 124/5 |
| 3,529,589 | 9/1970 | Esser | 124/5 |

FOREIGN PATENT DOCUMENTS

| | | | |
|---|---|---|---|
| 42,778 | 8/1965 | Germany | 273/73 R |

*Primary Examiner*—William H. Grieb
*Assistant Examiner*—T. Brown
*Attorney, Agent, or Firm*—Howard C. Miskin

[57] ABSTRACT

A tennis swing practice device includes a cylindrical guide receptacle of somewhat larger inside diameter than the diameter of a tennis ball medially releasably bolted to the head of a tennis racket and having a longitudinally forwardly facing end opening. Passage restrictions are located in the receptacle proximate the end opening so as to necessitate a minimum longitudinal force on a tennis ball in the receptacle for the tennis ball to be ejected from the receptacle attendant to the swinging of the racket. The restriction may be the head of a bolt securing the receptacle to the racket head or opposite forwardly converging shoulders located at the receptacle opening. The longitudinal axis of the receptacle is parallel to the racket striking face and may be at an angle of between 0° and 60° to the racket longitudinal axis.

5 Claims, 6 Drawing Figures

TENNIS RACQUET SWING TRAINING DEVICE

BACKGROUND OF THE INVENTION

The present invention relates generally to improvements in game and athletic devices and it relates more particularly to an improved device for practicing and developing an optimum tennis racket swing.

In the game of lawn tennis (includes tennis played on grass, clay and other court surfaces generally referred to as lawn tennis courts), an important factor in the playing of the game is the swing or stroke. In returning the tennis ball, not only must the ball be squarely met by the head of the tennis racket, but the swing of the racket should be such as to return the ball to the area desired at the desired velocity and with the desired spin and trajectory. An optimum relationship is a straight line with respect to the longitudinal axis of the racket, the wrist and the forearm when the ball is released from the racket head. In order to obtain the optimum swing considerable practice is necessary and this is best achieved by playing the game. However, game play is frequently not available and other means of practice must be available. While numerous solo tennis practicing devices have been available and proposed, these possess numerous drawbacks and disadvantages. They are awkward and inconvenient devices which neither develop a proper or optimum swing nor indicate when such swing has been achieved and otherwise leave much to be desired.

SUMMARY OF THE INVENTION

It is a principal object of the present invention to provide an improved athletic and game practice device.

Another object of the present invention is to provide an improved tennis practice device.

Still another object of the present invention is to provide an improved device for developing, practicing and perfecting the swing of the tennis racket.

A further object of the present invention is to provide an improved device for attachment to a conventional tennis racket to adapt it to solo use for developing the proper swing of the racket at no harm to racket or strings.

Another object of the present invention is to provide a device of the above nature characterized by its simplicity, ruggedness, reliability, ease and efficiency in application and mounting and great versatility and adaptability.

The above and further objects of the present invention will become apparent from a reading of the following description taken in conjunction with the accompanying drawing which illustrates preferred embodiments thereof.

A feature of the present invention is based on the discovery that the trajectory of a tennis ball propelled by centripetal force imparted to the ball which is releasably returned proximate the face of the racket by an outwardly directed guide member is an indication of the manner and quality of the swing particularly as related to its desired aim. The present invention accordingly contemplates the provision of a tennis swing practice device comprising a tennis racket including longitudinally spaced proximal handle portion and distal head portion and ball guide means located on the head portion for releasably retaining a ball and restricting the movement of the ball in a distal direction out of engagement with the guide means.

Advantageously, the racket is a conventional tennis racket including a strung head and the guide means is a cylindrical receptacle separably bolted to the racket head striking face and having an outwardly or distally directed end opening and an inside diameter somewhat greater than the diameter of a tennis ball. The receptacle is preferably medially located on the racket head and directed along the longitudinal axis parallel to the racket face or parallel to the racket face and at a selected angle of up to 60° to the longitudinal axis. The means releasably retaining the ball in the receptacle may be the heads of bolts securing the receptacle to the racket head or opposite lips or shoulders located at the receptacle open end or distorting the receptical out of round.

A tennis ball ejected and propelled from the receptacle attendant to the swinging of the tennis racket traverses a trajectory which is an indication of the quality of the swing and instructive in improving and developing the swing. The present device trains the user for the straight-in-line position of wrist, forearm and tennis handle at the moment of release of the ball from the racket. The device is reliable, simple and rugged, easy to apply to and remove from a conventional tennis racket and is of high versatility and adaptability.

DESCRIPTION OF THE PREFERRED EMBODIMENTS

Figure 1:
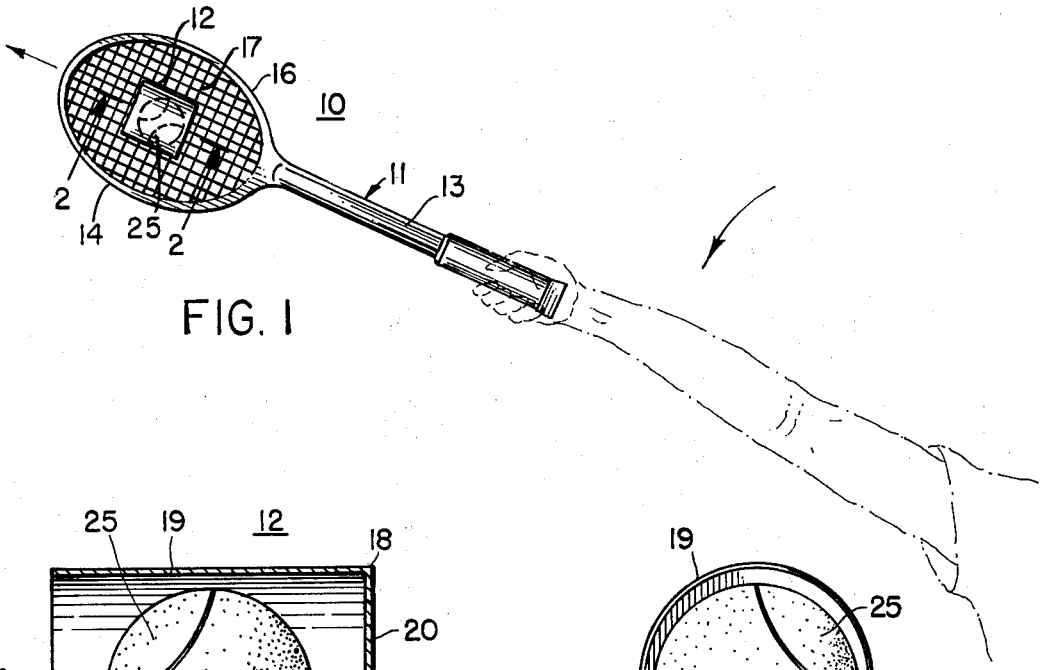
FIG. 1 is a front elevational view of the improved practice device illustrated in use.
Figure 2:
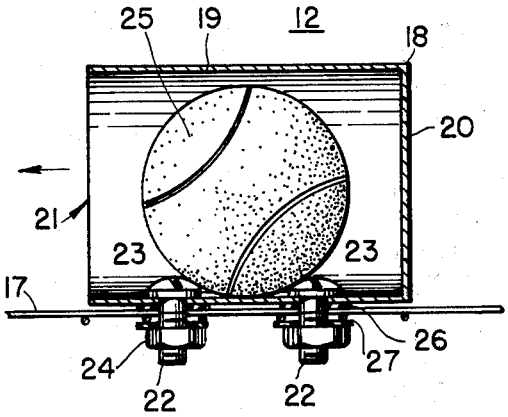
FIG. 2 is a sectional view taken along line 2—2, showing the ball guide device.
Figure 3:
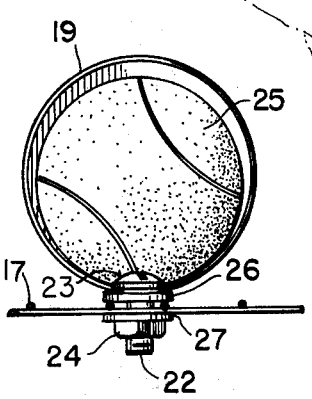
FIG. 3 is an end elevational view of the mounted ball guide device.

Referring now to the drawings, particularly FIGS. 1 to 3 thereof, which illustrate a preferred embodiment of the present invention, the reference numeral 10 generally designates the improved tennis swing practice device which comprises a tennis racket 11 and a detachable ball guide member 12. The tennis racket 11 is of conventional construction and includes a medially longitudinally extending proximal elongated handle 13 terminating in a grip portion and a distal striking head 14 medially extending from the distal end of the handle 13. The head 14 consists of a flat oval frame 16 strung in the usual menner with nylon monofilament, gut or the like to provide a resilient woven striking face or web 17.

The tennis ball retaining and guide member 12 comprises a circular cylindrical receptacle 18 having an inside diameter somewhat greater than the diameter of a standard tennis ball, for example about 1/16 inch greater and includes a peripheral wall 19 as rear end wall 20 and a front opening 21. While the guide receptacle 18 is advantageously medially mounted on the hitting side of the racket striking face 17 with its longitudinal axis parallel to the medial axis of the racket head 14, it may be adjusted to the desires of the user to any practical angle such as to 60° to the longitudinal axis of the racket 11 but is preferably maintained parallel to the web 17. The selection of the angle will depend on the stroke to be practiced. As shown in FIg. 1, the guide member 12 is mounted for forehand or backhand ground stroke. For slice service, an angle of about 60° to the longitudinal has been found satisfactory. The receptacle 18 is formed of any suitable strong light weight material such as thin sheet metal, a polymeric plastic such as nylon, polypropylene, ABS or the like.

The guide receptacle 18 is of a length greater than the diameter of the tennis ball and is separably secured to the striking web 17 at the desired angle to the longitudinal by a pair of longitudinally spaced bolts extending through corresponding apertures in the receptacle peripheral wall 19 and through aligned weave openings in the web 17. The bolts 22 are provided rounded enlarged heads 23 disposed within the receptacle 18 and the forwardmost bolt head 23 functions as a stop to releasably retain a tennis ball 24 within the receptacle 18 and to release it for ejection through front opening 21 upon sufficient outward or centripetal force be applied to the tennis ball. The diametric distance between the top of the bolt head 23 and the top of the inside face of receptacle 18 is slightly less than the diameter of the ball 24. Nuts 24 engage the outer ends of bolt 22 and washers 26 are sandwiched between receptacle peripheral wall 19 and web 17 and washers 27 are sandwiched between the nuts 24 and web 17 and the nuts 24 are tightened to effect a firm assembly of the guide receptacle 18 to the web 17. Advantageously, washers 26 and 27 are soft to protect the racket strings.

In the application and operation of the improved tennis practice device 10 for ground strokes, the guide receptacle 18 is mounted to the web 17 in the manner described with the axis through its open end that parallels that of the racket handle. The angle of the receptacle can be altered in accordance with the users desired swing as determined in part by whether a service or other stroke is practiced. A tennis ball 25 is inserted into receptacle past the forward stop defining bolt head 23 and the tennis racket 11 is then swung in the normal manner. When the centripetal force applied to the ball 24 attendant to the swinging of the racket 11 reaches a sufficient value the ball 25 is urged past the bolt head 23 and is ejected through the opening 21 and propelled along a trajectory which is an indication of the manner and quality of the swing. The operation is repeated as often as desired until the optimum trajectory and hence swing is achieved. Different types of swings effect different trajectories and these may be easily recognized.

Figure 4:
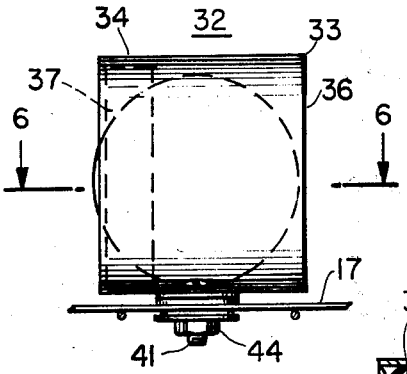
FIG. 4 is a front elevational view of a modified ball guide device which is mounted on a tennis racket in accordance with the present invention.
Figure 5:
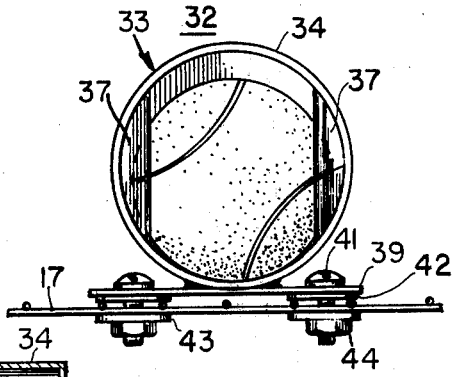
FIG. 5 is an end elevational view thereof.
Figure 6:
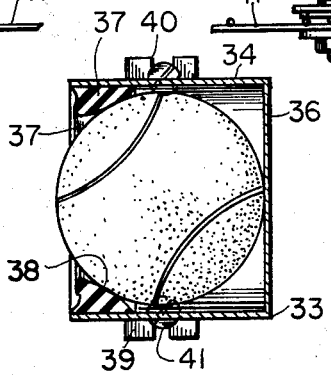
FIG. 6 is a sectional view taken along line 6—6 in FIG. 4.

In FIGS. 4 to 6 of the drawings, there is illustrated another embodiment of the present invention which differs from that first described in the construction of the guide member. Specifically the modified guide member 12 comprises a circular cylindrical receptacle 33 including a peripheral wall 34, a proximal end wall 36 and a distal or front opening 37. The depth of the receptacle 33 is about equal to or slightly less than the diameter of a tennis ball. Suitably secured to the inside face of peripheral wall 34 proximate opening 37 are a pair of diametrically opposite vertically extending parallel stop members or bars 37 having curved convex outwardly or forwardly converging confronting faces 38, the minimum distance between the faces 38 being somewhat less than the diameter of the tennis ball and the inside diameter of the receptacle 33 being somewhat greater than the diameter of the tennis ball.

Secured to the underface of the receptacle peripheral wall 34, such as by welding, is a transverse mounting cross bar 39 having end recesses 40. In the mounted condition of the guide receptacle 32, the cross bar 39 overlies the racket head web 17, being separated therefrom by intervening washers 42. Bolts 41 traverse cross bar recesses 40, washers 42, openings in web 17, and washers 32 underlying the web 17 and are engaged by nuts 44 which are tightened to secure the assembly to the web 17 without injury to the web. The angle of the longitudinal axis of the guide receptacle 32 to the longitudinal axis of the tennis racket is adjusted as earlier explained.

The application and operation of the practice device employing the modified guide member 32 is as above described in connection with the practice device 10.

While the description of the embodiments have been discussed in detail with respect to tennis, other rackets for sports can be so used, such as squash. Advantageously, the device should be mountable by finger pressure only and wing nuts may be used.

While there have been described and illustrated preferred embodiments of the present invention, it is apparent that numerous alterations, omissions and additions may be made without departing from the spirit thereof.

I claim:

1. A tennis swing practice device comprising a conventional tennis ball, a lawn tennis racket including longitudinally spaced proximal handle portion and distal head portion, said head portion including a peripheral frame and interwoven strings extending across said frame to define a striking web, and guide means separably secured to said head portion and including a longitudinally extending cylindrical receptacle releasably housing said tennis ball and having an open distal end and an inside diameter greater than the diameter of said tennis ball and means forward of said tennis ball in the direction of said distal end restricting the passageway along said receptacle to a dimension slightly less than the diameter of said tennis ball to necessitate a predetermined longitudinal pressure on said tennis ball to automatically traverse said restricting means while swinging of said tennis racquet.

2. The tennis swing practice device of claim 1 including a bolt securing said receptacle to said racket head portion and having an enlarged head located in said receptacle proximate its open end and defining said restricting means.

3. The tennis swing practice device of claim 1 wherein said restricting means includes a pair diametrically opposite parallel shoulder members located in said receptacle proximate the opening therein and having forwardly converging confronting faces.

4. The tennis swing practice device of claim 1, wherein the longitudinal axis of said guide means is substantially parallel to the striking face of said head portion.

5. The tennis swing practice device of claim 4 wherein the longitudinal axis of said cylindrical receptacle is at an angle of between 0° and 60° of the longitudinal axis of said racket.

* * * * *